US010760400B2

(12) United States Patent
Vorhoff

(10) Patent No.: US 10,760,400 B2
(45) Date of Patent: Sep. 1, 2020

(54) DIRECTIONAL DRILLING DEVICE AND METHOD FOR CALIBRATING SAME

(71) Applicant: Smart Drilling GmbH, Gelsenkirchen (DE)

(72) Inventor: Werner Vorhoff, Wesel (DE)

(73) Assignee: Smart Drilling GmbH (DE)

( * ) Notice: Subject to any disclaimer, the term of this patent is extended or adjusted under 35 U.S.C. 154(b) by 94 days.

(21) Appl. No.: 16/076,662

(22) PCT Filed: Feb. 8, 2017

(86) PCT No.: PCT/DE2017/000035
§ 371 (c)(1),
(2) Date: Aug. 8, 2018

(87) PCT Pub. No.: WO2017/137025
PCT Pub. Date: Aug. 17, 2017

(65) Prior Publication Data

US 2019/0048702 A1 Feb. 14, 2019

(30) Foreign Application Priority Data

Feb. 8, 2016 (DE) ..... 10 2016 001 780

(51) Int. Cl.
*E21B 7/04* (2006.01)
*E21B 47/024* (2006.01)
(Continued)

(52) U.S. Cl.
CPC ..... *E21B 44/005* (2013.01); *E21B 7/04* (2013.01); *E21B 7/06* (2013.01); *E21B 47/024* (2013.01);
(Continued)

(58) Field of Classification Search
CPC ..... E21B 44/005; E21B 7/04; E21B 47/024; E21B 47/0905
See application file for complete search history.

(56) References Cited

U.S. PATENT DOCUMENTS 3,587,175 A 6/1971 Armistead
3,691,363 A 9/1972 Armistead
(Continued)

FOREIGN PATENT DOCUMENTS

CN 103089242 A 5/2013
EP 1008717 A1 6/2000
EP 1514996 A1 3/2005

OTHER PUBLICATIONS

International Search Report dated May 29, 2017, for International Application No. PCT/DE2017/000035 (3 pgs).
(Continued)

*Primary Examiner* — Cathleen R Hutchins
(74) *Attorney, Agent, or Firm* — Conley Rose, P.C.

(57) ABSTRACT

The invention relates to a reliably functioning directional drilling device for continuous operation, with automatic, precision-controlled monitoring of targeted drilling at great depths with specification of a selectable directional path of the wellbore, comprising a housing, a bit drive shaft, which preferably rotates in the housing and which bears a rotary drill bit at its end, a control device located in the body section of the housing, and direction control devices for generating directing forces having radially alignable force components for the alignment of the directional drilling device during drilling operations, and magnetic field sensors that are connected to the control device, the magnetic field sensors being arranged in the head section, more specifically in the forward region of the housing facing the rotary drill bit, in close proximity to the rotary drill bit, i.e. near the
(Continued)

rotary drill bit, and being calibrated by means of the method of the invention using a homogeneous magnetic field generated by a Helmholtz coil.

14 Claims, 1 Drawing Sheet

(51) Int. Cl.

| | |
|---|---|
| ***E21B 47/09*** | (2012.01) |
| ***E21B 44/00*** | (2006.01) |
| ***E21B 7/06*** | (2006.01) |
| ***E21B 49/00*** | (2006.01) |
| *E21B 47/06* | (2012.01) |
| *E21B 47/18* | (2012.01) |

(52) U.S. Cl.
CPC ..... *E21B 49/00* (2013.01); *E21B 47/065* (2013.01); *E21B 47/18* (2013.01)

(56) References Cited

U.S. PATENT DOCUMENTS

| | | | | |
|---|---|---|---|---|
| 3,828,243 | A * | 8/1974 | Ward | G01R 33/24 324/301 |
| 4,109,199 | A * | 8/1978 | Ball | G01R 33/02 324/202 |
| 5,812,068 | A * | 9/1998 | Wisler | E21B 7/068 175/40 |
| 6,966,211 | B2 | 11/2005 | Wu | |
| 8,635,043 | B1 | 1/2014 | Olsson et al. | |
| 2003/0070844 | A1 | 4/2003 | Radzinski | |
| 2004/0149004 | A1 | 8/2004 | Wu | |
| 2011/0031025 | A1 * | 2/2011 | Kulkarni | E21B 10/62 175/76 |
| 2012/0298421 | A1 * | 11/2012 | Coates | E21B 47/182 175/50 |
| 2014/0138157 | A1 | 5/2014 | Heisig | |
| 2016/0299252 | A1 * | 10/2016 | Zacharko | G01V 3/38 |

OTHER PUBLICATIONS

First Office Action dated Mar. 31, 2020, and Search Report, for Chinese Patent Application No. 201780016389.0.

* cited by examiner

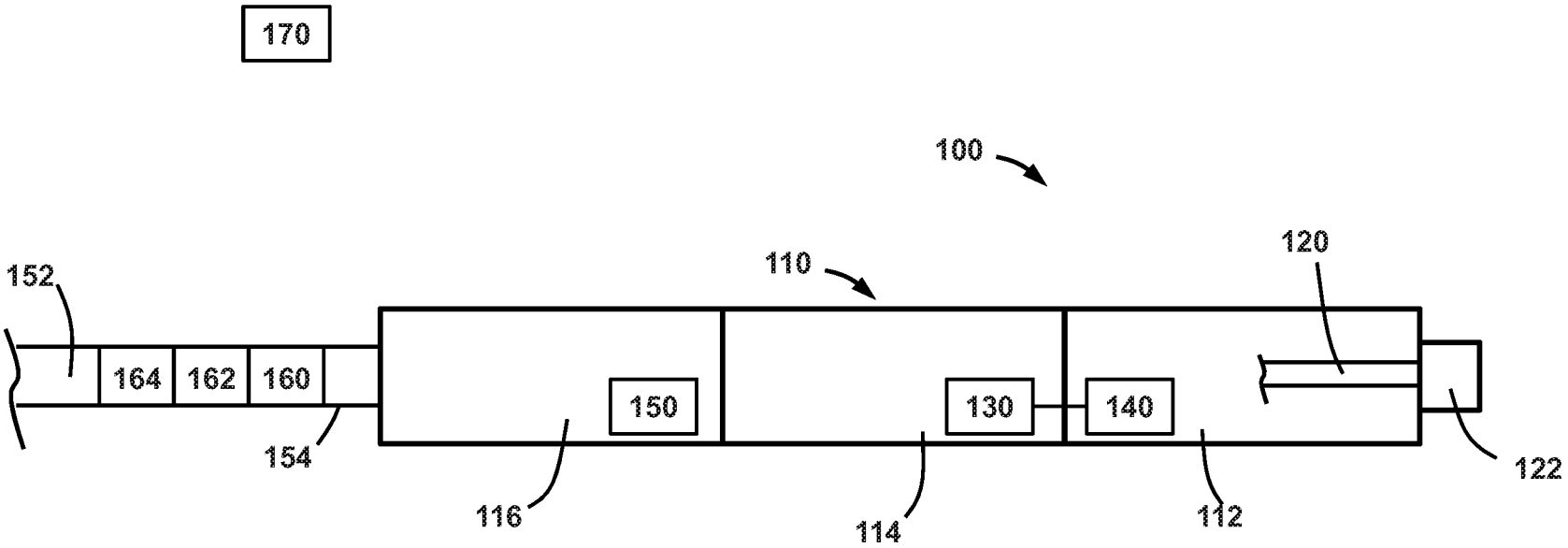
100
110
112
114
116
120
122
130
140
150
152
154
160
162
164
170

DIRECTIONAL DRILLING DEVICE AND METHOD FOR CALIBRATING SAME

CROSS-REFERENCE TO RELATED APPLICATIONS

This application is a 35 U.S.C. § 371 national stage application of PCT/DE2017/000035 filed Feb. 8, 2017, entitled "Directional Boring Device and Method for Calibrating Same," which claims priority to German application No. DE 10 2016 001 780.5 filed Feb. 8, 2016, both of which are incorporated herein in their entirety for all purposes.

STATEMENT REGARDING FEDERALLY SPONSORED RESEARCH OR DEVELOPMENT

Not applicable.

BACKGROUND

The invention relates to a cost-efficient method for calibrating magnetic field sensors in a high-precision directional drilling device, for the early, reliable and timely localization of the wellbore with specification of a selectable directional path of the wellbore for deep drilling, and to a directional drilling device comprising a housing, a bit drive shaft, which rotates in the housing and bears a rotary drill bit at its end that preferably protrudes from the housing, and also comprising a control device connected to magnetic field sensors and located within the housing, and a plurality of direction control devices, located within the housing, for generating directing forces having radially alignable force components for the alignment of the directional drilling device during drilling operations.

Directional drilling is the term used for drilling methods that allow the direction of a bore to be influenced. Complex systems are used to alter and determine the path of the wellbore in any direction. Values for inclination and magnetic north, inter alia, are measured. The sensors for detecting magnetic north are placed in non-magnetizable steels at a sufficient distance from any parts that might cause magnetic interference. Only in this way can magnetic north be detected without interference and drilling routed in the proper, i.e. predefined, direction. When using directional drilling equipment, it is advantageous for the measurements of inclination and direction to be taken as close behind the bit as possible to ensure that the wellbore is following a controlled and planned desired path. In modern rotary steerable systems, only the inclination sensor is integrated directly into the system, while the direction sensors are located in a non-magnetic sector located many meters behind the system to enable magnetic north to be detected with the required accuracy. Without appropriate corrections, integrating the direction sensors and the detection of magnetic north together with the inclination sensors in the directional drilling device would result in magnetic declination and would allow major inaccuracies in direction sensing.

Conventional directional drilling devices comprise a tubular housing. The drill pipe string, also called the drill string, is accommodated inside the housing, at least in the base section thereof facing away from the rotary drill bit. The rotary drill bit is located in the head section of the housing; at least a portion of the bit drive shaft to which the rotary drill bit is coupled is likewise positioned rotatably in the head section of the housing. The base section merges into the body section of the housing, which merges into the head section. In conventional directional drilling devices, the magnetic field sensors are located in the base section of the housing, as far as possible from the head section and the body section of the housing, in an effort at least to diminish the magnetic declinations, which occur even during operation of the rotary drill bit and are generated as a result of the devices, components, etc. being built into the head section and body section of the housing, and the influence of such declinations on the magnetic field sensors by spacing or distancing the magnetic field sensors from the head section of the housing in conventional drilling devices. Despite the spatial distancing of the magnetic field sensors from the head section and body section, interference with the acquisition of position data acquired by magnetic field sensors is nevertheless manifested in conventional directional drilling devices, and as a result, directional deep drilling using conventional directional drilling devices does not correspond to the desired path of the sunk wellbore.

Moreover, another relevant disadvantage of using conventional directional drilling devices is actually caused by the spatial distance of the magnetic field sensors from the head section of the housing; because of the great distance of the magnetic field sensors from the head section, slight deviations of the head section in conventional directional drilling devices in, e.g. three spatial directions are not detected at an early stage, rather, these early deviations in direction can only be identified later by means of the magnetic field sensors located in the base section. Since the deviations in direction are detected only after a certain period of time, subsequent corrections in the directional path of the sunk bore are necessary, and the later the directional deviations of the rotary drill bit are detected, the more time-consuming and costly the corrections of the directional drilling will be. Efforts in the prior art to directional deviations of the head sections of directional drilling devices by installing the magnetic field sensors at least near the head section in conventional directional drilling devices, as described below, have failed due to the significant increase in the occurrence of magnetic declinations with the decrease in the spatial distance of the magnetic field sensors from the head section.

BRIEF SUMMARY

A further subject matter of the invention relates to a reliably functioning, high-precision directional drilling device for continuous operation, with automatic, precision-controlled monitoring of targeted drilling at great depths with specification of a selectable directional path of the wellbore, comprising a housing, a bit drive shaft, which preferably rotates in the housing and which bears a rotary drill bit at its end that protrudes from the housing, a control device, preferably a plurality of direction control devices, located within the housing, for generating directing forces having radially alignable force components for the alignment of the directional drilling device during drilling operations, and magnetic field sensors that are connected to the control device, said directional drilling device being characterized in that the magnetic field sensors are arranged in a forward region of the housing, facing the rotary drill bit, in a region close to the drill bit, and are calibrated using a homogeneous magnetic field generated by Helmholtz coils.

Devices for sinking vertical bores or curved bores, primarily large diameter bores, are known in the art, which inadequately meet practical demands, notably in terms of efficiency and safety, but especially in terms of the accuracy of the orientation of the wellbore. The ability to monitor and control drills used for directional drilling at great depths is essential. Monitoring capability is essential for verifying the position of the wellbore and the path of the bore, and for correcting any undesirable deviations. Control capability is likewise essential, e.g. both for maintaining the verticality and the curvature of deep bores, and preferably for intervening in the drilling process during operation. Deviations in wellbores typically occur in deep layers of rock formations, and are also induced by different hardnesses of solid rock and loose rock. Deviations may also be caused during drilling by the excessive length of the drill pipe string, also called the drill pipe, and the variable force that is exerted on the drill pipe.

To avoid wellbore deviations, in one conventional device having a rotary drill bit, e.g. a directional drilling device, for sinking vertical or curved bores which comprises a drilling tool, outwardly pivotable steering ribs, also called sliding skids, clamping pieces, sliding ribs, etc., are arranged around the exterior of said drilling tool and are placed, force-loaded, against the wall of the wellbore. Applying force against the wall of the wellbore, hereinafter referred to simply as the wellbore wall, causes the rotary drill bit of the conventional device to be diverted in the opposite direction. Obviously, however, the conventional device can be steered only from the outside from an above-ground control console. However, controlling the direction control devices of the conventional directional drilling device from the above-ground control console results in a delayed response in pivoting the steering ribs so that, among other things, valuable time for correcting the orientation of the wellbore underground is lost, with costly consequences.

A deviation of a wellbore from its specified direction may also be caused by the torque and the forward drilling force exerted by the rotary drill bit on the formation. According to DE 602 07 559, the size and the direction of wellbore deviation are always unpredictable and always require the rotary drill bit to be steered via the drilling tool or the directional drilling device.

In a conventional device for producing directed bores, having a sensor system with a sensing element, the steering ribs attached to the device are controlled in accordance with the deviations in the measured values for said device. The orientation of the wellbore path and the monitoring of the wellbore have been found to be inadequate, however, since the measured values from the inclinometer and the magnetic field sensors used as sensor systems are processed not in real time but with a delay from an above-ground control console, where they are compared with specified target values, after which control signals are forwarded to the steering ribs, which are connected electrically via cables for the purpose of control.

Although the conventional methods and devices disclosed by Schlumberger Technology B.V. have acknowledged the problem of delayed response in implementing corrective measures and the long-known but hitherto unsolved problem of magnetic declination, only the aforementioned disadvantageous positioning of the magnetic field sensors remotely from the drill head has been practically implemented. Thus, even Schlumberger Technology B.V. has failed to satisfactorily solve both problems at the same time, since the determination of wellbore inclination and wellbore azimuth during drilling based on a discrete number of longitudinal points along the axis of the wellbore by estimating at least two local magnetic field components by means of transaxial magnetic field sensors and transaxial accelerometers complicates the design of the device, rendering the conventional method prone to failure, and does not achieve magnetic field measurement near the rotary drill bit, let alone magnetic field measurement next to the drill bit or immediately adjacent to the rotary drill bit.

The sensor systems have therefore been left widely spaced from the rotary drill bit, and Schlumberger Technology B.V. has admitted that the technique of using magnetic field measurements to determine deviations near the drill head is inadequate.

In the conventional device, i.e. directional drilling tools and devices, positioning the magnetic field sensors near the drill head was not technically feasible, but it was urgently needed, especially since this would open up entirely new applications and major new possibilities for directional deep drilling; as Schlumberger Technology B.V. has acknowledged, axial magnetic field measurements have remained particularly sensitive to magnetic interference or declinations coming from nearby drill string components such as the drill head, the mud motor, the reaming bit, etc., and therefore, conventional teaching advises the use of magnetic field sensors only remotely from the drill head, i.e. the positioning of magnetic field sensors remotely from the rotary drill bits in the conventional directional drilling device. Near the drill head is also understood to mean near the drill bit.

Thus, since the magnetic field sensors detect changes in direction of the rotary drill bit only with a significant delay due to the distance of the sensors from the drill bit, this prior art accepts the fact that directional deep drilling is costly due to the delayed response in implementing correction measures, and that, due to the lengthening of deep drilling distances that result from the delayed response times, deep drilling using conventional directional drilling equipment or tools is not economically advisable in light of today's ever-increasing relevance of the cost-benefit analysis of deep well drilling using the conventional devices recommended by Schlumberger Technology B.V.

Particularly with the development of new gas or oil fields using conventional directional drilling equipment or tools, which are likewise recommended by Schlumberger Technology B.V., the operation of deep drilling tools is time-consuming and costly given the use of fracking methods to process already developed fields.

Moreover, the method known in the prior art in which a wellbore sensor is introduced into a wellbore and the conventional wellbore sensor is adjusted, using an inclination coil integrated into the conventional wellbore sensor, to generate a predefined magnetic field for the purpose of measuring inclination values offers no solution, because, although the conventional wellbore sensor is capable of detecting directional values for a location within the wellbore in three spatial directions, the measurement of the wellbore and of the path thereof takes place only after the wellbore has been sunk and the conventional wellbore sensor has been introduced into the already sunk wellbore.

Nor does the conventional method overcome the disadvantage of directional drilling devices in which the magnetic field sensors are located remotely from the rotary drill bit in the conventional directional drilling devices.

The object of the invention is further to provide a directional drilling device that eliminates or compensates for the deviations or declinations generated by the use of various materials in the directional drilling device, in a timely manner, already and directly during deep drilling, and, despite the magnetic interference fields that occur during deep drilling, maintains the inclination and the predefined drilling path in three spatial directions during deep directional drilling without the need for above-ground intervention, even during ongoing drilling operations, in contrast to the prior art, especially since above-ground intervention is possible only after the conventional wellbore sensor has been introduced into the wellbore.

The object is further to provide such a directional drilling device that makes both the introduction of the conventional wellbore sensor into the wellbore and the subsequent above-ground intervention superfluous.

The directional drilling device is further to be equipped with magnetic field sensors in its forward region that faces the rotary drill bit, i.e. in the region bordering the rotary drill bit, to avoid even the slightest deviations in the inclination and azimuth of the directional drilling device, which are induced, e.g. by the presence of different rock hardnesses and are measurable near the rotary drill bit.

The calibration of conventional magnetic field sensors is disclosed in multiple publications, knowledge that offers nothing new to those skilled in the art. For instance, in a further prior art, a conventional wellbore sensor is provided which is capable of detecting the spatial directions of a location in a wellbore and of determining deviations thereof from target values, but the conventional wellbore sensor does not simultaneously enable both drilling and constant control of the monitoring of the directional variables during drilling on site, i.e. the directional variables peculiar to the conventional rotary drilling device and associated therewith during the drilling.

This prior art also confirms the acknowledgement by Schlumberger Technology B.V. that overcoming the disadvantages of the delayed response of above-ground intervention by implementing corrective measures in the drilling being performed using the conventional directional drilling device is considered impossible in the prior art, so that the constant monitoring of azimuth and inclination must be maintained despite the cost due to the occurrence, e.g. of magnetic measurement deviations.

The object of the directional drilling device and the method to be provided is therefore to provide a directional drilling device which, for example during drilling, measures the deviations in deep drilling immediately by means of magnetic field sensors next to the rotary drill bit of the directional drilling device, compares these deviations with target values, generates corresponding corrective signals for controlling the directional drilling device, and forwards these in a timely manner, without delay, without a loss of time and without expense, to the correcting elements, such as clamping elements, of the directional drilling device, independently of any external control, i.e. control from outside of the directional drilling device.

To increase accuracy in determining magnetic flux densities, in one wellbore measuring method magnetic field sensors may be used which are arranged rotating about the longitudinal axis of the device and which send signals induced by the existing geomagnetism to the above-ground control console, however the magnetic field sensors are still spaced a substantial distance from the rotary drill bit, so that slight changes in the path of the wellbore cannot be detected, and intervention at an early stage into the directional deep drilling operations is not possible.

The object of the invention is to provide a method for the simple calibration of magnetic field sensors in a directional drilling device.

The method should further be capable of detecting deviations in the directional drilling device during deep drilling operations in advance, and of storing corrective measures.

In addition, the directional drilling device to be provided should be capable of easily detecting slight deviations from the desired path of the wellbore during drilling at great depths.

The directional drilling device to be provided should further comprise magnetic field sensors positioned near the drill head.

The directional drilling device is likewise to be capable not only of detecting even slight deviations from the desired path of the wellbore, but also of implementing corrective measures in a timely manner to maintain the desired drilling path.

The directional drilling device to be provided should also be capable of correcting any changes in the drilling path without risk of influence by magnetic interference fields on the orientation of directional deep drilling.

In addition, control of the directional drilling device from an above-ground control console is to be superfluous in that the control console is relieved of the task of implementing measures to correct undesirable wellbore deviations and is responsible only for controlling the deep drilling process as such.

In addition, the directional drilling device to be provided should be capable of controlling itself in real time, thereby avoiding the costly lengthening of the drilling path that results from the subsequent implementation of deviation corrections.

Moreover, the method to be provided is to be designed for the cost-effective calibration of the directional drilling device, so that the problem acknowledged by Schlumberger Technology B.V. but not solved by Schlumberger Technology B.V. of positioning magnetic field sensors near the drill head in directional drilling devices is solved and the complicated and failure-prone method proposed by Schlumberger Technology B.V. is avoided.

Smart Drilling GmbH positions the sensors, i.e. magnetic field sensors, for sensing inclination and direction in the directional drilling device according to the invention and performs a correction to maintain the required accuracies. The invention solves the problem by using a Helmholtz coil. At the center of the Helmholtz coil, the existing magnetic field including the geomagnetic field is neutralized, i.e. there is no magnetic field. The directional drilling device according to the invention, including the directional sensors, i.e. magnetic field sensors, is then positioned in the neutral magnetic field of the coil. Since various components that generate magnetic interference are located in the directional drilling device according to the invention, the directional sensors now in the Helmholtz coil show the magnetic declination in x, y and z axes. This interference is then advantageously compensated for until a neutral magnetic field is again present and is stored as correction values in the electronic memory of the directional drilling device of the invention. All operating functions of the directional drilling device of the invention can then be run through in the Helmholtz coil, the magnetic declinations can be measured and compensated for, and the correction factors can be stored in the directional drilling device. Thus, the directional drilling device according to the invention is able to compensate for itself during operation and meet stringent requirements for directional accuracy.

BRIEF DESCRIPTION OF THE DRAWINGS

FIG. 1 is a schematic view of a directional drilling device according to some embodiments.

DETAILED DESCRIPTION

The objects are attained by the main claim and the secondary independent claim, with the dependent claims relating to preferred embodiments and refinements of the invention.

The invention relates to a method in which a directional drilling device is used, comprising a housing, a bit drive shaft, which rotates or is rotatable at least partially in a head section of the housing, and which bears a rotary drill bit, in the head section and at the lower end of said bit drive shaft, which preferably protrudes from the housing, the head section merging into a body section of the housing, a control device located within the body section of the housing, a plurality of magnetic field sensors connected to said control device, the body section merging into a base section of the housing, a plurality of direction control devices located in the body section or the base section of the housing for the purpose of generating directing forces having radially alignable force components for the alignment of the directional drilling device during a drilling operation, which is characterized in that the magnetic field sensors are located in the head section of the housing and are calibrated using a homogeneous magnetic field generated by the Helmholtz coil, wherein the directional drilling device including the magnetic field sensors is introduced into the magnetic field generated by the Helmholtz coil and is positioned centrally in said magnetic field, in a predefined position as the reference standard, to compensate for magnetic interference fields, the magnetic declinations influenced by magnetic interference fields are determined by the magnetic field sensors as magnetic flux densities in the direction of the X, Y, and Z axes, and the measured values corresponding to these magnetic flux densities are generated as magnetic declination values or signals, and the magnetic declination values or signals are forwarded to the control device, correction values corresponding to the magnetic declination values or signals are generated by the control device, said correction values corresponding to the magnitude of the measured values of deviations in the magnetic flux densities, produced by the interference fields, from the measured values of the magnetic flux density at the reference standard, and these correction values are stored in an electronic memory of the control device of the directional drilling device, and/or c. the directional drilling device is then positioned in the magnetic field generated by the Helmholtz coil in alignments that differ from the predefined position, e.g. as operating functions, the magnetic declinations influenced by these alignments are determined by magnetic field sensors as magnetic flux densities in the direction of the X, Y and Z axes, and the corresponding measured values resulting from these magnetic declinations due to the different alignments, e.g. as operating functions, are forwarded as position values or signals to the control device, correction factors corresponding to the position values or signals are generated by the control device for the purpose of moving the directional drilling device back to the predefined position, and these correction factors are stored in the electronic memory of the control device of the directional drilling device.

The invention is also directed to a reliably operating directional drilling device for continuous operation, with automatic precisely controlled monitoring of targeted drilling at great depths, with specification of a selectable directional path of the wellbore, said device comprising a housing, a bit drive shaft, which rotates or is rotatable at least partially in a head section of the housing, and which bears a rotary drill bit, in the head section and at the lower end of said bit drive shaft, which preferably protrudes from the housing, the head section merging into a body section of the housing, a control device located within the body section of the housing, a plurality of magnetic field sensors connected to said control device, the body section merging into a base section of the housing, a plurality of direction control devices located in the body section or the base section of the housing for the purpose of generating directing forces having radially alignable force components for the alignment of the directional drilling device during a drilling operation, which is characterized in that the magnetic field sensors are located in the head section of the housing and are calibrated using a homogeneous magnetic field generated by the Helmholtz coil, and the directional drilling device along with the magnetic field sensors is introduced into the magnetic field generated by the Helmholtz coil and is positioned centrally in said field in a predefined position as the reference standard, to compensate for magnetic interference fields, the magnetic declinations influenced by magnetic interference fields are determined by the magnetic field sensors as magnetic flux densities in the direction of the X, Y, and Z axes, and the measured values corresponding to these magnetic flux densities are generated as magnetic declination values or signals, and the magnetic declination values or signals are forwarded to the control device, correction values corresponding to the magnetic declination values or signals are generated by the control device, said correction values corresponding to the magnitude of the measured values of deviations in the magnetic flux densities, produced by the interference fields, from the measurements of the magnetic flux density at the reference standard, and these correction values are stored in an electronic memory of the control device of the directional drilling device, and/or the directional drilling device is then positioned in the magnetic field generated by the Helmholtz coil in alignments that differ from the predefined position, e.g. as operating functions, the magnetic declinations influenced by these alignments are determined by magnetic field sensors as magnetic flux densities in the direction of the X, Y and Z axes, and the corresponding measured values resulting from these magnetic declinations due to different alignments, e.g. as operating functions, are forwarded as position values or signals to the control device, correction factors corresponding to the position values or signals are generated by the control device for the purpose of moving the directional drilling device back to the predefined position, and these correction factors are stored in the electronic memory of the control device of the directional drilling device.

The directional drilling device according to the invention may comprise a housing, the base section of which, opposite the head section, is provided for accommodating a drill pipe string and/or a coupling to a drill pipe string, a bit drive shaft, which is located in the head section and preferably rotates in the same or at least partially in the housing, and which bears a rotary drill bit at its end, e.g. protruding from the housing, a control device located within the housing, preferably in the body section and/or the base section thereof, preferably a plurality of direction control devices located in the housing, preferably in the body section and/or the base section thereof, for generating directing forces having radially alignable force components for the alignment of the directional drilling device during drilling operations, and a plurality of magnetic field sensors, the magnetic field sensors being arranged in the head section of the housing, specifically in the region of the housing near the drill bit, and being inserted into a frame that contains the Helmholtz coil, by the method according to the invention, and said magnetic field sensors being calibrated using the homogeneous magnetic field generated by the Helmholtz coil. The invention also relates to a method for calibrating magnetic field sensors in a high-precision directional drilling device for the early, reliable and timely determination of the position of the wellbore and the alignment of the rotary drill bit relative to the geomagnetic field vector, with specification of a selectable, i.e. predefined, directional path of the wellbore for deep drilling, where calibration is performed in a magnetic field generated by Helmholtz coil.

The invention is also directed to the use of a homogeneous magnetic field generated by a Helmholtz coil for the purpose of calibrating a directional drilling device, which comprises a housing, a bit drive shaft, which rotates or is rotatable at least partially in a head section of the housing, and which bears a rotary drill bit, in the head section and at the lower end of said bit drive shaft, which preferably protrudes from the housing, the head section merging into a body section of the housing, a control device located within the body section of the housing, a plurality of magnetic field sensors connected to said control device, the body section merging into a base section of the housing, a plurality of direction control devices located in the body section or the base section of the housing for the purpose of generating directing forces that have radially alignable force components for the alignment of the directional drilling device during a drilling operation, wherein the magnetic field sensors are located in the head section of the housing and are calibrated using a homogeneous magnetic field generated by the Helmholtz coil, and the directional drilling device along with the magnetic field sensors is introduced into the magnetic field generated by the Helmholtz coil and is positioned centrally in said field in a predefined position as the reference standard, to compensate for magnetic interference fields, the magnetic declinations influenced by magnetic interference fields are determined by the magnetic field sensors as magnetic flux densities in the direction of the X, Y, and Z axes, and measured values corresponding to these magnetic flux densities are forwarded as magnetic declination values or signals to the control device, correction values corresponding to the magnetic declination values or signals are generated by the control device, said correction values corresponding to the magnitude of the measured values of deviations in the magnetic flux densities, produced by the interference fields, from the measured values of the magnetic flux density at the reference standard, and these correction values are stored in an electronic memory of the control device of the directional drilling device, and/or the directional drilling device is then positioned in the magnetic field generated by the Helmholtz coil in alignments that differ from the predefined position as operating functions, the magnetic declinations influenced by these alignments are determined by magnetic field sensors as magnetic flux densities in the direction of the X, Y and Z axes, and the corresponding measured values resulting from these magnetic declinations due to different alignments/operating functions are forwarded as position values or signals to the control device, correction factors corresponding to the position values or signals are generated by the control device for the purpose of moving the directional drilling device back to the predefined position, and these correction factors are stored in the electronic memory of the control device of the directional drilling device.

The method according to the invention, in which the directional drilling device is used, comprising a housing, a bit drive shaft, which rotates in the housing and bears a rotary drill bit at its end that protrudes from the housing, and also comprising a control device located within the housing, magnetic field sensors connected to said control device, and a plurality of direction control devices, located within the housing, for generating directing forces having radially alignable force components for the alignment of the directional drilling device during drilling operations, comprises the following steps:

positioning the magnetic field sensors in a forward region of the housing facing the rotary drill bit, i.e. in the region near the drill bit, and calibrating the sensors by means of a homogeneous magnetic field generated by the Helmholtz coil.

For the purposes of the invention, positioning in the head section of the housing is also understood as positioning in the region near the drill bit, also called the rotary drill bit, which is next to the rotary drill bit in the directional drilling device of the invention, or is immediately adjacent to the rotary drill bit in the directional drilling device of the invention, or is in close proximity to the rotary drill bit, without the rotary drill bit and the magnetic field sensors interfering with one another during operation of the directional drilling device according to the invention, in contrast to the prior art. For the purposes of the invention, this also means that, in contrast to the prior art, the rotary drill bit and the magnetic field sensors are not spaced apart from one another, an arrangement which is in contrast to the spatial distance between the magnetic field sensors and the head section heretofore required in the prior art, and which does not follow the rule of conventional teaching which holds that the magnetic field sensors must be located in the region distant from the rotary drill bit in conventional directional drilling devices in order to avoid mutual influence or to avoid interference with the magnetic field sensors, e.g. by the magnetic declinations occurring in the region of the rotary drill bit during drilling.

A further subject matter of the invention relates to a reliably functioning, high-precision directional drilling device for continuous operation, with automatic, precisely controlled monitoring of targeted drilling at great depths with specification of a selectable directional path of the wellbore, comprising a housing, a bit drive shaft, which preferably rotates in the housing and which bears a rotary drill bit at its end that protrudes from the housing, a control device, preferably a plurality of direction control devices, located within the housing, for generating directing forces having radially alignable force components for the alignment of the directional drilling device during drilling operations, and magnetic field sensors that are connected to the control device, said directional drilling device being characterized in that the magnetic field sensors are arranged in a forward region of the housing, facing the rotary drill bit, in a region close to the drill bit, and are calibrated using a homogeneous magnetic field generated by Helmholtz coil.

The invention is also based upon the compensation, also referred to as offsetting in the context of the invention, of the influence on the magnetic declinations or the magnetic flux densities thereof, induced by magnetic interference fields, using the magnetic flux densities without interference fields in the magnetic field generated by Helmholtz coil, so that the influence thereof is eliminated, and the subsequent compensation of operating functions, i.e. various alignments or positions of the directional drilling device within the magnetic field generated by Helmholtz coil, which differ from a predefined position of the directional drilling device, also referred to as the reference standard, enabling the directional drilling device to be returned to the predefined position; these steps are also referred to as calibration in the context of the invention.

With the method according to the invention, the magnetic field sensors of the directional drilling device of the invention, which are advantageously arranged in the forward region of the housing facing the rotary drill bit, i.e. next to the rotary drill bit or immediately adjacent thereto, are preferably calibrated by means of a magnetic field generated by Helmholtz coil. For the purposes of the invention, Helmholtz coil or Helmholtz coils is also understood to mean the arrangement of two coils for the purpose of generating a homogeneous magnetic field, at least one largely homogeneous magnetic field sufficient for calibration of the directional drilling device of the invention; the superimposition of the magnetic fields of the two coils of the Helmholtz coils advantageously results in the homogeneous magnetic field near the axes. Simply stated, the conditions underground, which may correspond, e.g. to the operating functions, can also be simulated by means of a magnetic field.

The method according to the invention also relates to the calibration of magnetic field sensors in a homogeneous magnetic field generated by Helmholtz coil, since the magnetic field sensors are arranged in the directional drilling device of the invention in the region of the housing that is close to the rotary drill bit of the directional drilling device of the invention. The magnetic interference fields, called hard or soft iron effects, which are generated, e.g. by the rotary drill bits, possibly the mud motor, and the reaming bit and which can interfere with or at least influence the geomagnetic field, are usually compensated for by means of the method according to the invention in the directional drilling device according to the invention. The degree of compensation can be measured qualitatively and quantitatively and stored in the control device.

For the method of the invention, the directional drilling device of the invention is used, which comprises a housing, within which a bit drive shaft can be arranged to rotate. The bit drive shaft can be coupled at its upper end, which protrudes from the housing, to a drill pipe string. The control device is located within the housing and is connected to the magnetic field sensors, which are arranged immediately adjacent to the rotary drill bit. As is well known to those skilled in the art, the conventional control device may comprise a sensor system and/or a programmable measured-value receiver and/or a programmable measured-value processor, etc., which may be interconnected for the purpose of forwarding, exchanging and/or processing data, signals, declination values, declination signals, correction values, position values, position signals, or correction factors generated by the control device for the purpose of returning the directional drilling device to its predefined position, and these correction factors may be stored in the electronic memory of the control device of the directional drilling device. In preferred embodiments of the method of the invention and of the directional drilling device of the invention, the magnetic field sensors in the form of a sensor system may also be a component of the control device.

The steps of the method according to the invention include:

the directional drilling device including the magnetic field sensors is introduced into the magnetic field generated by Helmholtz coil and is positioned centrally in said magnetic field, in a predefined position as the reference standard, to compensate for magnetic interference fields, the magnetic declinations influenced by magnetic interference fields are determined by the magnetic field sensors as magnetic flux densities in the direction of the X, Y, and Z axes, and measured values corresponding to these magnetic flux densities are forwarded as magnetic declination values/signals to the control device, correction values corresponding to the magnetic declination values or signals are generated by the control device, said correction values corresponding to the magnitude of the measured values of deviations in the magnetic flux densities, produced by the interference fields, from the measured values of the magnetic flux density at the reference standard, and these correction values are stored in an electronic memory of the control device of the directional drilling device, and/or the directional drilling device is then positioned in the magnetic field generated by the Helmholtz coil in alignments/operating functions that differ from the predefined position, the magnetic declinations influenced by these alignments are determined by magnetic field sensors as magnetic flux densities in the direction of the X, Y and Z axes, and the corresponding measured values resulting from these magnetic declinations due to different alignments/operating functions are forwarded as position values or signals to the control device, correction factors corresponding to the position values or signals are generated by the control device for the purpose of moving the directional drilling device back to the predefined position, and these correction factors are stored in the electronic memory of the control device of the directional drilling device.

For the purposes of the invention, connection is also understood as a conventional electrical connection for control purposes, e.g. among the magnetic field sensors and the control connection, the direction control devices and the control device for the purpose of exchanging or at least forwarding data, measured values or signals. For the purposes of the invention, a control device is also understood as a conventional control device equipped with a programmable measured-value receiver, a programmable measured-value processor, etc., which are well known to those skilled in the art. The connection may be wireless, wired, ultrasonic, infrared, or a data communication connection via Bluetooth, etc., in analog and/or digital form and/or encoded.

For the purposes of the invention, magnetic field sensors are also understood as conventional magnetic field sensors, e.g. measured-value receivers, which are likewise well known to those skilled in the art. Also located within the housing are a plurality of direction control devices, arranged in or on the housing, for generating directing forces that have radially alignable force components for the alignment of the directional drilling device according to the invention during drilling operation. In the directional drilling device of the invention, the housing is advantageously arranged rotatably about the drill pipe supporting edge and/or the bit drive shaft.

Thus, in a first step, in this case a., the directional drilling device of the invention can be introduced, along with its magnetic field sensors, into the homogeneous magnetic field generated by Helmholtz coil and positioned centrally in said homogeneous magnetic field in a predefined position as the reference standard.

In one particular embodiment of the method according to the invention and of the directional drilling device according to the invention, the directional drilling device of the invention is introduced into the Helmholtz coil, or is inserted into a preferably cage-like structure containing at least one Helmholtz coil, which includes the two coils. In one embodiment of the method according to the invention, a homogeneous magnetic field is generated conventionally by means of the Helmholtz coil, the coils, e.g. toroidal coils, of the Helmholtz coil advantageously being arranged on the same axis, in particular having an identical radius, and/or the axial distance between the coils corresponding to the coil radius. The coils are thus each connected via a feed device to a generator, and the coils can be electrically connected in series for a clockwise flow of current. The generation by means of Helmholtz coil of homogeneous magnetic fields, into which a directional drilling device is introduced and centered therein, and which calibrate said device are known in the art, and therefore, data regarding the number of turns N, the radius of the two coils, the frequency, the magnetic flux density, and the current intensity I for the operation of said device are unnecessary; the two coils of the Helmholtz coil may also be referred to as Helmholtz coils, as is sometimes customary.

To compensate for the magnetic interference fields, magnetic flux densities are determined in the subsequent step, e.g. step b. The determination of said flux densities is known to a person skilled in the art; thus, in step b., for example, the minimum and the maximum magnetic flux density in the direction of each axis, i.e. in the direction of the X, Y and Z axes, can be determined by the magnetic field sensors. In this step, the deviations of the magnetic flux densities, occurring as a result of magnetic interference fields and measured by magnetic field sensors, can be determined as measured values or measured variables from the measured values for magnetic flux densities without magnetic interference fields, as the normal reference or reference standard, and can be documented, e.g. stored in the control device. If necessary, the magnitude of the measured values as deviations of the magnetic flux densities in the presence of magnetic interference fields as compared with the measured values for magnetic flux density in the absence of magnetic interference fields may also be calculated or correlated and stored in the control device, i.e. in the electronic memory thereof.

The magnetic field sensors generate the declination values or declination signals corresponding to the measured values and forward them via the outputs of said sensors to the input of the control device. Correction values corresponding to the declination values or declination signals can be generated by the control device. These may correspond to the magnitude of the changes or deviations, produced by the interference fields, between the measured values for the magnetic flux densities and the measured values for magnetic flux density with the reference standard without interference fields. The correction values are stored in the control device, preferably in the electronic memory thereof, of the directional drilling device of the invention.

In a further step, e.g. c, the directional drilling device of the invention is arranged centrally in the magnetic field generated by the Helmholtz coil, in various alignments that differ from the predefined position, referred to here as the normal position.

The magnetic declinations as measurements of magnetic flux densities, influenced by these alignments, can be determined in the direction of each axis, i.e. in the direction of the X, Y and Z axes, by the magnetic field sensors of the directional drilling device of the invention. For the processing of measured values and the control of the direction control devices of the directional drilling device of the invention, a control loop for multivariable control is provided in the control device of the same. The various alignments may correspond to the operating functions on-site of the directional drilling device of the invention, which may occur on-site in the rock during deep drilling. The corresponding measured values for magnetic flux densities, resulting from the most varied alignments, are forwarded as position values, also called position signals, via the outputs of the magnetic field sensors to the input of the control device. The correction factors corresponding to the position values are generated by the control device and can serve to move the directional drilling device of the invention back from its various alignments to its predefined position. The position values as control variables can also typically be compared with specified target values, and in the event of deviations, modified output variables can be forwarded as corrective signals to the direction control devices for the purpose of adjusting, e.g. inclinations and/or azimuth. The position values in the form of actual values may deviate from the position of the directional drilling device of the invention predefined by the target value as the normal reference or reference standard, and therefore, the correction values may correspond to manipulated variables, or in the case of a deviation, the output variables in the form of adjustment factors, determined after the position values have been adjusted by correction values, may correspond to manipulated variables, which can be forwarded to the direction control devices of the directional drilling device of the invention.

The measured variables to be assigned to the normal position or the reference standard may also be regarded as specified target values for the position values input into the control device, provided that, in the event of deviations from these, the correction factors are forwarded as manipulated variables to the direction control devices of the directional drilling device of the invention in order to generate directional forces having radially alignable force components against the wellbore wall. The measured values determined in step c. by the magnetic field sensors can be adjusted by the correction values, or cleaned up as it were, by the control device. The correction factors are stored in an electric or electronic memory of the control device of the directional drilling device of the invention, so that, when necessary, the position values are optionally compared with specified target values in real time and without recourse to an above-ground control console, and the correction factors corresponding to the position values are forwarded as control signals that correspond to manipulated variables to the direction control devices of the directional drilling device of the invention.

By calibrating the magnetic field sensors of the directional drilling device according to the invention in the homogeneous magnetic field, all magnetic interference fields induced by external influences near the magnetic field sensors, such as hard and soft magnetic materials, are effectively qualitatively detected and their magnitude is quantitatively determined, making the cumbersome calibration of the magnetic field sensors for example in conventional field stations without the influence of other interfering magnetic declinations unnecessary.

Furthermore, in step c. the correction factors can be adjusted by the correction values to produce adjustment factors, so that the adjustment factors correspond to the actual values for the alignments that deviate from the predefined position. The adjustment factors can be compared with specified target values, e.g. which correspond to the specified target values for the predefined position in the magnetic field, and based on the deviations from specified target values, modified output variables can be generated as corrective signals or control signals, which are used for actuating the direction control devices.

In a further embodiment of the method according to the invention and of the directional drilling device according to the invention, other sensor systems, in particular temperature sensors, inclination sensors, acceleration sensors, gamma radiation sensors, gyroscopic sensors and/or other WOB sensors for precisely determining the position of the directional drilling device of the invention at a specific point in time may also be connected to the control device in the housing of the directional drilling device of the invention.

The method according to the invention ensures that the directional drilling device according to the invention is calibrated in a simple and cost-effective manner.

Magnetic interference fields which are caused by the ferromagnetic materials present in the directional drilling device according to the invention and which influence magnetic flux density are taken into account and compensated for at an early stage.

In further embodiments of the directional drilling device according to the invention, the measured variables for determining the directional path of the wellbore can likewise be forwarded via cable, via telemetry and/or in the form of pressure signals and/or pulses, such as sound waves, from an above-ground control console to the control device and back. The transmission of control signals or other data, such as measured variables, to the control device or from the control device to the control console is likewise possible, as will be explained further below.

In further embodiments of the method according to the invention, the aforementioned steps can also be carried out in the presence of specified temperatures or temperature ranges, since the transmission properties in the magnetic field sensors may be temperature-dependent within the directional drilling device of the invention, etc.

The advantage of the directional drilling device according to the invention is also based on the fact that the magnetic field sensors located in the head section not only detect deviations of the wellbore at an early stage, but also detect slight deviations of the rotary drill bit located in the head section at an early stage, and the control device of the directional drilling device of the invention can implement the corrective measures in real time, without external intervention, using as a basis the specified target values programmed into the control device, e.g. target values for the inclination and direction of the wellbore, and/or correction values, correction factors and adjustment factors.

Since additional sensor systems are also provided, these systems can determine additional measured values or variables and forward these to the control device, which is equipped with a control loop for multivariable control for the purpose of controlling the direction control devices; the control variables are supplied to this control loop as actual values from the sensor systems, and these control variables are compared in the control loop with specified target values, so that, when deviations occur, the manipulated variables are supplied in the form of control signals to the direction control devices, as disclosed in DE 199 50 040.

With the expedient cooperation of the sensor systems with one another via the control device, any distortions or declinations that may occur between the individual sensor systems and the measured variables from these are avoided and are coupled to one another via the control loop for multivariable control in such a way that flawless monitoring and adjustment of the programmed target value specifications in the directional drilling device is ensured.

The direction control devices of the directional drilling device according to the invention may be embodied as bracing devices, which have actuating means and to which anchoring elements are coupled, which are arranged distributed over the circumference of the housing along at least one bracing plane, are movable radially outwardly and inwardly, and are retractable shield-like into grooves in the housing, and the mobility of which is temperature-controlled by means of the positioning means having at least one heat-expandable pressure medium; the pressure medium is a solid material and or a liquid, the solid material has a linear expansion coefficient $\alpha$ at 20° C. of 1.5 to $30.0\times10^{-6}K^{-1}$ and/or the liquid has a coefficient of volume expansion $\gamma$ at 18° C. of 5.0 to $20.0\times10^{-4}K^{-1}$, wherein, e.g. the anchoring elements are articulated to the actuating means, the actuating means is embodied as a piston-cylinder assembly, the cylinder space of which has a heating device for heating the pressure medium, the outer end of the piston is coupled to the anchoring element, and the cylinder space is filled with the liquid or gas as the pressure medium. Thus, the anchoring elements can be articulated to the actuating means, wherein the actuating means is embodied as a piston-cylinder assembly, the cylinder space of which is connected to a chamber of a chamber housing so as to allow the passage of pressure medium, the cylinder space and the chamber are filled with the liquid or the gas as pressure medium, a heating device is positioned on at least a portion of the inner and/or outer walls of the chamber housing for the purpose of heating the housing and the pressure medium, the outer end of the piston is coupled to the anchoring element, the cylinder space of the piston-cylinder assembly includes a heating device for heating the pressure medium, the outer end of the piston is coupled to the anchoring element, the cylinder space is filled with the liquid or gas as the pressure medium and/or when the pressure medium is heated, the piston is displaced radially to the longitudinal center axis of the housing in order to place the anchoring element, force-loaded, against a wellbore wall during the transition of said anchoring element from the home position to the end position, and when the pressure medium is chilled, the piston is displaced radially to the longitudinal center axis of the housing in order to place the anchoring element against the housing during the transition of said anchoring element from the end position to the home position. The pressure medium may have a coefficient of volume expansion $\gamma$ at 18° C. of 7.2 to $16.3\times10^{-4}K^{-1}$, more preferably of 12 to $15\times10^{-}$ $_4K^{-1}$, and/or the solid may have a coefficient of linear expansion $\alpha$ at 0° C. or 20° C. of 3.0 to $24\times10^{-6}K^{-1}$, more preferably of 10.0 to $18.0\times10^{-6}K^{-1}$. The actuating means may be embodied as a linear drive, which has at least one rod formed from the solid material, to the outer end of which the clamping piece is coupled, the solid material having a coefficient of linear expansion $\alpha$ at 0° C. or 20° C. of 3.0 to $24\times10^{-6}K^{-1}$, more preferably of 10.0 to $18.0\times10^{-6}K^{-1}$; in addition, the piston-cylinder assembly is embodied as dual-action, and the opposing piston surfaces may be acted on by temperature-controlled pressure media.

In a further embodiment of the directional drilling device of the invention, the pressure pulses may be transmitted in flowing media for the transmission of information to the control device, in particular during the production of bores in underground mining and tunneling operations, through the flushing channel of the drill pipe string which can be coupled to the bit drive shaft, in which case an impeller is disposed in the flushing channel of the drill pipe string and can be switched between generator and motor operation, and can therefore be operated alternatingly. In this case, the impeller with the coils associated with the drill pipe string may have correspondingly mounted magnets. The coils can be connected to energy accumulators, with the coil wheel advantageously being axially disposed. In addition, the impeller may be mounted on guides that are supported against the inner wall of the flushing channel of the drill pipe string, as disclosed in DE 41 34 609.

In another embodiment of the directional drilling device of the invention, information may be transmitted from the control device via the drill pipe string and within the same by means of pressure pulses in a flowing liquid, preferably called drilling liquid or drilling fluid, in which case the directional drilling device of the invention comprises a device, connected to the control device, for transmitting the information, in particular during the production of bores, by means of pressure signals in flowing liquid, preferably drilling liquid; the device includes an information generating means, a transmitting device connected to the information generating means and designed for generating the pressure pulses in the liquid, and a receiving device for receiving and analyzing the information transmitted by means of the pressure pulses in the control console, the transmitting device including a resilient flow resistor in the liquid stream and an actuating means for modifying the flow cross-section of the flow resistor in synchronization with the pressure pulses to be generated, as disclosed in DE 196 07 402.

For generating the pressure pulses, the transmission device may have a resilient flow resistor in the liquid stream and an actuating means for controlling the flow cross-section of the flow resistor in synchronization with the pressure pulses to be generated. The advantage of this transmission is its compact and cost-saving design along with the low-wear and low-energy nature of pressure pulse transmission, and the fact that, although the moving parts are easily replaced, flawless transmission of the information is ensured. With this measure, a flow resistor having a variable flow cross-section is located in the liquid stream or in the drilling liquid stream. By adjusting the flow cross-section of the flow resistor, pressure pulses can be generated in the direction of flow in the region of and behind the flow resistor, and these pressure pulses can be propagated in the direction of flow of the liquid stream or the drilling liquid stream. These pressure fluctuations or pressure pulses can be reduced such that, when the flow cross-section is reduced and the liquid stream remains the same, the flow velocity around the flow resistor is increased and as a result, the liquid pressure partially decreases. A reduction in the flow cross-section therefore leads to a partial increase in pressure in the liquid stream. In this way, pressure fluctuations or pressure pulses can be generated in a targeted manner in the liquid stream. Due to the resiliency of the flow resistor, this generation can be reproduced with the aforementioned process being repeated as often as desired, nearly without wear. Moreover, the response times of the resilient flow resistor are advantageously short enough that clean rising and falling edges of the pressure pulses can be generated. In this way, undisrupted information transmission continues to be possible, because the edge steepness of the generated pressure pulses is sufficient to actuate subsequent, for example digital analysis devices.

Finally, in another embodiment of the directional drilling device according to the invention, the control device of the same is connected to a device for transmitting information within the drill pipe string by means of pulses, such as sound waves; a transmitting device for generating the pulses may be connected to an information generating device, e.g. as part of the control device, connected downstream of the rotary drill bit, in which case the device likewise comprises a receiving device for receiving and analyzing the information transmitted via pulses, and the pulses generated by the transmitting device are embodied as sound waves and are forwarded to the receiving device, as disclosed in DE 10 2012 004 392. The sound waves can be triggered by means of mechanical, hydraulic, electrical and/or pneumatic pulses.

Deviations of the directional drilling device according to the invention from a specified position, here called the normal or predefined position, are detected not only early, but in real time without intervention from an above-ground control console and without the delay this intervention causes, and corrective measures are implemented immediately to correct the position of the directional drilling device with the rotary drill bit according to the invention.

The corrective measures are implemented during deep drilling operations, without interruption.

Because the magnetic field sensors are located in the region near the drill bit in the directional drilling device of the invention, the directional drilling device of the invention, in contrast to the method and devices promoted by Schlumberger Technology B.V., is capable of detecting even the slightest deviations from the wellbore path and of correcting these deviations accordingly with the aid of the direction control devices, actuated by the control device, of the directional drilling device of the invention, along with the steering ribs thereof, by extending said ribs while drilling operations are ongoing.

It should further be noted that in the prior art of conventional directional drilling devices, the magnetic field sensors are located so far away from the rotary drill bit in the directional drilling device that the sensors do not detect changes in the curvature of the wellbore until the changes in the azimuthal angle are well advanced, so that not only is the drilling path lengthened significantly but considerable additional, albeit unnecessary, operating costs are disadvantageously incurred.

The directional drilling device of the invention and the method of the invention for calibrating the same are further distinguished by the following advantages:

the wellbore and the path thereof are measured immediately during the sinking of the wellbore, without any delay, no introduction of a wellbore sensing element into the already sunk wellbore is necessary, actual values in the form of direction and inclination values are determined by magnetic field sensors that are arranged in the head section of the housing of the directional drilling device of the invention, i.e. next to the rotary drill bit of the directional drilling device of the invention, rather than as far as possible from the drill bit, as in the prior art, deviations and declinations are detected at an early stage—as early as and directly during deep drilling operations, predefined wellbore inclination and direction are maintained despite magnetic interference fields, which are typically encountered during deep drilling and are caused, e.g. by rock formations, no above-ground intervention from a control center is necessary, which in the prior art leads to delays and expense, an early, i.e. highly sensitive response is provided to the slightest deviations in the inclination and azimuth of the directional drilling device according to the invention, which are induced, e.g. by the occurrence of different rock hardnesses and are measurable in the head section, i.e. in close proximity to the rotary drill bit, drilling is combined simultaneously with constant control of the monitoring of the directional variables during drilling on site, the delayed response of above-ground intervention is avoided by the implementation of corrective measures in prompt response to measurements of the directional deviations of the head section in terms of inclination and azimuth, and the resulting prevention of the increase in the wellbore length and in the duration of deep drilling, which is knowingly accepted in the prior art due to the delayed initiation of correction measures;

the anchoring elements of the directional drilling device are extended against the wellbore wall at an early stage, independently of above-ground actuation, and thus with a cost savings.

Exemplary Embodiment

In the exemplary embodiment, the method according to the invention for calibrating magnetic field sensors in a high-precision directional drilling device for the early, reliable and timely localization of the wellbore in layers of earth with specification of a selectable directional path of the wellbore for deep drilling, and the reliably operating directional drilling device according to the invention for continuous operation with automatic, precisely controlled monitoring of targeted drilling at great depths with specification of a selectable directional path of the wellbore, are described schematically.

The directional drilling device according to the invention comprises a housing, the magnetic field sensors, which are arranged in the housing and are arranged in close proximity to the rotary drill bit, i.e. in the head section of the housing, and therefore near the drill bit, the control device, which is arranged in the body or base section and the intake of which is electrically connected or linked in terms of control processes to the outputs of the magnetic field sensors and to the inputs of the direction control devices located on or in the body or base section of the housing, and the bit drive shaft with the rotary drill bit, which is mounted rotatably at least partially in the head section of the housing.

For the purposes of the invention, arrangement in the head section of the housing, in close proximity to the rotary drill bit or next to or adjacent to the rotary drill bit in the forward region, facing the rotary drill bit and adjoining the rotary drill bit, or near the drill bit can also be understood to mean that no spacing of the magnetic field sensors from the rotary drill bit is required, i.e. the spacing and thus the spatial distance that is required and unavoidable in the prior art; instead, the magnetic field sensors border the rotary drill bit, as close as is technically feasible, so that the movements, e.g. the rotational movements, of the rotary drill bit cannot damage the magnetic field sensors, e.g. by milled-off rock, while at the same time, the magnetic field sensors cannot restrict the movements of the rotary drill bit due to their spatial proximity, and thus cannot restrict the rotational freedom of the rotary drill bit.

The directional drilling device according to the invention is inserted into a frame that contains the Helmholtz coil, so that said drilling device can be positioned centrally within the homogeneous magnetic field generated by the Helmholtz coil, in a predefined position as a reference standard, in accordance with step a. of the method. In a further step, e.g. step b., the magnetic declinations, which are also influenced by the magnetic interference fields, are determined by the magnetic field sensors as measured values or measured variables for the magnetic flux densities in the direction of the X, Y and Z axes, so that these measured values can be forwarded as declination values or declination signals via the output of said magnetic field sensors to the input of the control device. Correction values corresponding to the declination values are generated by the control device; said correction values may correspond after calibration to the deviations, as declination values, from the measured values for magnetic flux densities without interference fields or to the magnitude of the measured values for the deviations, produced by the interference fields, of the magnetic flux densities from the measurements of magnetic flux densities without magnetic interference fields, in particular, as the reference standard. The correction values are stored in an electronic memory of the control device of the directional drilling device.

In the next step, e.g. c, the directional drilling device according to the invention is placed in the magnetic field generated by the Helmholtz coil and in alignments or operating functions that differ from the predefined position as the reference standard, and the magnetic declinations influenced by these alignments are determined by the magnetic field sensors of the directional drilling device according to the invention as measured variables for magnetic flux densities in the direction of the X, Y and Z axes; the corresponding measured values or measured variables resulting from these different alignments are forwarded as position values or position signals via the outputs of the magnetic field sensors to the input of the control device. The correction factors corresponding to the position values are generated by the control device, with the help of which the directional drilling device of the invention can be moved back from its various alignments to a predefined position as the reference standard.

The correction factors can be stored in the electronic memory of the control device. The correction factors may correspond to a specific control signal or manipulated variable for the direction control devices, for the purpose of moving the directional drilling device of the invention into a predefined position. With the help of the stored correction factors, the control device can use the control signals corresponding to the correction factors to move the directional drilling device of the invention back to a predefined position by means of the direction control devices thereof. The correction factors may correspond to the actual values for the alignments that differ from the predefined position, so that once the correction factors have been compared with the specified target values corresponding to the predefined position, the control device the direction control devices are moved into a predefined position by means of the control signals communicated to said devices.

In a further exemplary embodiment, the correction factors are adjusted by the correction values to generate adjustment factors, such that said adjustment factors can also be used to move the directional drilling device according to the invention back from the various alignments to the predefined position as the reference standard. The adjustment factors may correspond to the actual values for the alignments that differ from the predefined position, so that once the adjustment factors or correction factors have been compared with the specified target values corresponding to the predefined position of the directional drilling device of the invention, the control device, based on the control signals communicated to it, uses the direction control devices of the directional drilling device of the invention to move said directional drilling device back to a predefined position by means of generated output variables or manipulated variables. It is also possible for control signals corresponding to the correction factors and/or adjustment factors to be generated for actuation of the direction control devices by the control device, e.g. as manipulated variables, for the automatic alignment of the directional drilling device of the invention in a predefined position.

The method according to the invention and the directional drilling device according to the invention enable simple calibration, the early detection of deviations in the deep drilling path, the first ever realization of the problem, hitherto recognized as technically unsolved, which has long been known, namely the positioning of magnetic field sensors in close proximity to the drill bit in the directional drilling device according to the invention, the early implementation of corrective measures, the detection of even minor deviations from the desired path of the wellbore when drilling at great depths, monitoring of very tightly curved paths of the wellbore during drilling at great depths, the implementation of corrective measures in the event of minor deviations from the desired path of the wellbore at great depths, correction for the purpose of altering the drilling path without risk of magnetic interference fields influencing the orientation, the elimination of steering of the directional drilling device from an above-ground control console, automatic control of the directional drilling device in real time without costly lengthening of the drilling distance, the provision of magnetic field sensors in close proximity to the drill bit in the directional drilling device, the elimination of complex, failure-prone procedures, in contrast to the methods and devices disclosed by Schlumberger Technology B.V. in U.S. Ser. Nos. 13/323,116 and 13/429,173, and the simple and rugged design of the directional drilling device according to the invention and thus a cost-effective production method.

In addition, the interference-free wireless transmission of signals from the above-ground control console to the directional drilling device according to the invention allows the directional path of the wellbore for deep drilling to be selected at any time.

Referring to FIG. 1, an embodiment of a directional drilling device 100 is shown. Directional drilling device 100 generally includes a housing 110, a bit drive shaft 120, a control device 130, a plurality of magnetic field sensors 140, and a plurality of direction control devices 150. Housing 110 comprises a head section 112 that merges into a body section 114. Body section 114 of housing 110 merges into a base section 116 of housing 110. Bit drive shaft 120 is configured to rotate at least partially in the head section 112 of the housing 110 and bear a rotary drill bit 122 in the head section of the housing 110 at a lower end of the bit drive shaft 120. Control device 130 is located within the body section 114 of housing 110 and is connected to the plurality of magnetic field sensors 140 which are located in the head section 112 of housing 110. In the embodiment shown in FIG. 1, the plurality of direction control devices 150 are located in the base section 116 of the housing 110; however, in other embodiments, the plurality of magnetic field sensors 140 may be located in the body section 114 of housing 110

In this embodiment, directional drilling device 100 also includes a data transfer system or transmitter in the form of a flow resistor or impeller 160 for transmitting signals generated by the magnetic field sensors 140 to an above-ground console 170. The impeller 160 is located in a flushing channel 152 of a drill string 154 and may include an impeller housing, an impeller shaft located in the impeller housing, and a compensating piston located in the impeller housing. The impeller 160 may drive a generator 162 to which an accumulator 164 is connected.

The invention claimed is:

1. A method for using a directional drilling device, comprising:

rotating a bit drive shaft at least partially in a head section of a housing, wherein the bit drive shaft bears a rotary drill bit at a lower end of the bit drive shaft, the head section merges into a body section of the housing, and the body section merges into a base section of the housing;

locating a control device in the body section of the housing, wherein a plurality of magnetic field sensors are connected to said control device;

locating a plurality of direction control devices in at least one of the body section and the base section of the housing for generating directing forces that have radially alignable force components for an alignment of the directional drilling device during a drilling operation, wherein the magnetic field sensors are located in the head section of the housing and are calibrated using a homogeneous magnetic field generated by a Helmholtz coil;

introducing the directional drilling device into the magnetic field generated by the Helmholtz coil and positioning the directional drilling device centrally in said magnetic field in a predefined position as a reference standard;

determining magnetic interference declinations influenced by magnetic interference fields as magnetic interference flux densities in the direction of X, Y and Z axes using the magnetic field sensors and forwarding a plurality of first measured values corresponding to the magnetic interference flux densities as magnetic interference declination values to the control device;

generating correction values corresponding to the magnetic interference declination values using the control device, wherein the correction values correspond to deviations of the magnetic interference flux densities from a reference magnetic flux density measured at the reference standard;

storing the correction values in an electronic memory of the control device;

positioning the directional drilling device disposed in the magnetic field in altered alignments that differ from the predefined position following the generation of the correction values;

determining magnetic position declinations influenced by the altered alignments of the direction drilling device by the magnetic field sensors as magnetic position flux densities in the direction of the X, Y and Z axes, and forwarding a plurality of second measured values corresponding to the magnetic position flux densities as position values to the control device generating correction factors corresponding to the position values using the control device for moving the directional drilling device back to the predefined position; and storing the correction factors in the electronic memory of the control device.

2. The method according to claim 1, further comprising adjusting the first measured values by the correction values to represent the reference standard.

3. The method according to claim 1, further comprising adjusting the correction factors by the correction values to produce adjustment factors that correspond to the deviation of the altered alignments of the directional drilling device from the predefined position.

4. The method according to claim 1, wherein the predefined position corresponds to a selectable directional path of a wellbore for deep drilling.

5. The method according to claim 1, wherein at least one of introducing the direction drilling device into the magnetic field, positioning the directional drilling device in the predefined position as the reference standard, determining the magnetic interference declinations, forwarding the plurality of first measured values, generating the correction values, determining the magnetic position declinations, forwarding the plurality of second measured values, and generating the correction factors is carried out at a predefined temperature.

6. The method according to claim 1, further comprising connecting the housing, a temperature sensor, an inclination sensor, an acceleration sensor, a gamma radiation sensor, and a gyroscopic sensor as a sensor system to the control device.

7. The method according to claim 1, forwarding at least one of the first measured values and the second measured values via at least one of a cable arranged in a drill pipe string and wellbore propagated pressure signals from an above-ground control console to the control device.

8. A directional drilling device, comprising:

a housing;

a bit drive shaft configured to rotate at least partially in a head section of the housing and bear a rotary drill bit in the head section of the housing at a lower end of said bit drive shaft, wherein the rotary drill bit protrudes from the housing, the head section merges into a body section of the housing, and the body section merges into a base section of the housing;

a control device located within the body section of the housing;

a plurality of magnetic field sensors connected to said control device, wherein the magnetic field sensors are located in the head section of the housing and are calibrated using a homogeneous magnetic field generated by Helmholtz coils;

a plurality of direction control devices located in at least one of the body section and the base section of the housing and configured to generate directing forces that have radially alignable force components for an alignment of the directional drilling device during a drilling operation;

wherein the magnetic sensors are configured to determine magnetic interference declinations influenced by magnetic interference fields as magnetic interference flux densities in the direction of X, Y, and Z axes;

wherein the magnetic sensors are configured to forward a plurality of first measured values corresponding to the magnetic interference flux densities as magnetic interference declination values to the control device;

wherein the control device is configured to generate correction values corresponding to the magnetic interference declination values, and wherein the correction values correspond to deviations of the magnetic interference flux densities from a reference magnetic flux density measured at a reference standard;

wherein the control device is configured to store the correction values in an electronic memory of the control device;

wherein the magnetic sensors are configured to determine magnetic position declinations influenced by altered alignments of the directional drilling device as magnetic position flux densities in the direction of the X, Y and Z axes;

wherein the magnetic sensors are configured to forward a plurality of second measured values corresponding to the magnetic position declinations as position values to the control device;

wherein the control device is configured to generate correction factors corresponding to the position values for moving the directional drilling device back to the predefined position; and wherein the control device is configured to store the correction factors in the electronic memory of the control device.

9. The directional drilling device according to claim 8, wherein the control device is connected to and configured to actuate an electrically operable direction controller, wherein the direction controller includes steering ribs arranged along at least one bracing plane coupled to the housing and distributed over the circumference of the housing, wherein the steering ribs are movable radially outwardly and inwardly, and wherein the radial movability of said steering ribs are temperature controlled.

10. The directional drilling device according to claim 9, wherein the direction controller includes an actuator assembly to which the steering ribs are coupled, wherein the actuator assembly comprises piston-cylinder assemblies actuatable by a heat-expandable pressure medium.

11. The directional drilling device according to claim 8, wherein:

the directional drilling device comprises a transmitter for generating pressure signals for transmitting signals generated by the magnetic field sensors to an above-ground console in a flushing channel of a drill pipe string by means of an impeller acted on by drilling liquid and which drives a generator to which an accumulator is connected;

wherein the generator includes the accumulator, and wherein an impeller shaft is supported within an axially extending impeller housing filled with oil and forming a cylindrical annular gap in relation to the drill pipe string and wherein the drilling fluid runs within the annular gap to drive the impeller, and a pressure compensating piston acted on by the drilling fluid is provided in an oil reservoir formed in the impeller housing, and a seal is provided at the lower end between the impeller housing and an impeller shaft.

12. The directional drilling device according to claim 8, wherein the directional drilling device comprises a data transfer system for generating pressure signals in flowing media for the purpose of transmitting data signals through a flushing channel of a drill pipe string, wherein in the flushing channel of the drill pipe string an impeller is positioned, and wherein the impeller is switchable between generator and motor operation.

13. The directional drilling device according to claim 12, wherein:

the data transfer system is configured to forward the data signals in the form of pressure signals to an above-ground control console, wherein the control device is connected to a device for transmitting information within the drill pipe string by means of pressure pulses comprising sound waves;

wherein the control device is connected to a transmitting device for generating the pressure pulses, and wherein the data transfer system comprises a receiving device for receiving and analyzing the information transmitted via the pressure pulses.

14. The directional drilling device according to claim 8, wherein the directional drilling device comprises a data transfer system for transmitting data signals using pressure pulses in a fluid stream, wherein the data transfer system comprises a transmitting device connected to the control device for generating the pressure pulses, and a receiving device for receiving and analyzing the data signals transmitted via the pressure pulses in an above-ground control console, wherein the transmitting device includes a resilient flow resistor in the fluid stream and an actuating means for modifying a flow cross-section of the flow resistor in synchronization with the pressure pulses to be generated.

* * * * *